United States Patent [19]

Anderson

[11] Patent Number: 4,641,428

[45] Date of Patent: Feb. 10, 1987

[54] AUTOMATIC METHOD OF MAKING TERMINATED COAXIAL LEADS

[75] Inventor: James D. Anderson, Norwalk, Conn.

[73] Assignee: Burndy Corporation, Norwalk, Conn.

[21] Appl. No.: 784,395

[22] Filed: Oct. 4, 1985

[51] Int. Cl.[4] ..... H01R 43/04

[52] U.S. Cl. ..... 29/863; 29/564.4; 29/564.6; 81/9.51

[58] Field of Search ..... 81/9.51; 29/33 M, 564.4, 29/564.6, 564.8, 857, 828, 861, 748, 863; 140/105

[56] References Cited

U.S. PATENT DOCUMENTS

| | | | |
|---|---|---|---|
| 3,029,494 | 4/1962 | Andren | 29/828 |
| 3,872,584 | 3/1975 | Chick et al. | 29/564.4 X |
| 3,881,374 | 5/1975 | Gudmestad | 81/9.51 |
| 3,961,703 | 6/1976 | McKeever | 140/105 |
| 4,077,118 | 3/1978 | McKeever | 29/748 |
| 4,107,838 | 8/1978 | Keen et al. | 29/564.6 X |
| 4,145,807 | 3/1979 | Beetz et al. | 29/564.4 X |
| 4,166,315 | 9/1979 | Gudmestad et al. | 29/564.6 X |
| 4,238,981 | 12/1980 | Karl | 81/9.51 X |

*Primary Examiner*—Howard N. Goldberg
*Assistant Examiner*—Carl J. Arbes
*Attorney, Agent, or Firm*—Perman & Green

[57] ABSTRACT

An automatic process and apparatus for producing terminated coaxial cable jumpers. A control system utilizing a microprocessor accepts push button entry of variables such as job identification number, quantity to be produced, jumper length, and jumper configuration. In addition to the control system, the apparatus includes a feed-measure-cut system for introducing raw lengths of jumpers into the process and a conveyor system for transporting the jumpers, in stepped sequence, to a series of work stations which operate on at least one end of each jumper and finally result in completed jumpers. Tests are performed at some of the work stations and those jumpers which fail any of the tests are removed from the process.

20 Claims, 12 Drawing Figures

COLLECTOR TRAY
CONVEYOR DRIVE
ACCEPT MARKER
CONTACT FEEDER
STRIP TEST
INNER END TRIM
FEED & MEASURE ROLLS
FIRST STATION
SECOND STATION
THIRD STATION
FOURTH STATION
FIFTH STATION
IDLE
SIXTH STATION
SEVENTH STATION
EIGHTH STATION
NINTH STATION
TENTH STATION
20
22
24
26
28
30
32
34
35
36
38
40
42
44
46
50
52
54
56
66
68
72
74
76
78
82
84
90
94
100
120
122
124
126
128
130
132

FIG. 7.

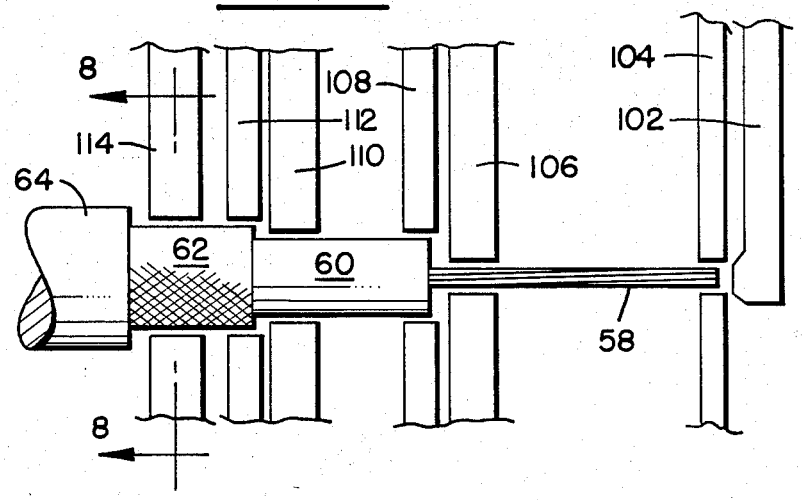

FIG. 8.

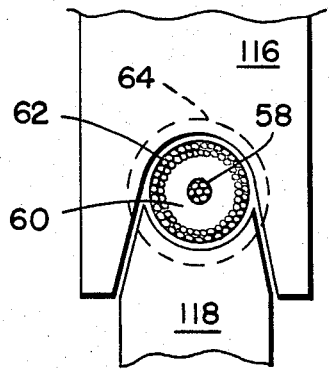

FIG. 9.

| TEST BETWEEN | CONDITION FOUND | DECISION | PROBABLE CAUSE OF FAULT |
|---|---|---|---|
| 102 & 104 | SHORTED | REJECT | TRIM KNIFE DULL OR BROKEN STATION NO.3 OUT OF POSITION |
| | OPEN | ACCEPT | |
| 104 & 106 | SHORTED | ACCEPT | |
| | OPEN | REJECT | INNER STRIPPER BLADE DULL OR BROKEN |
| 106 & 108 | SHORTED | REJECT | BRAID CUTTING KNIFE DULL OR CHIPPED STATION NO. 2 OUT OF POSITION |
| | OPEN | ACCEPT | |
| 108 & 110 | SHORTED | REJECT | BRAID CUTTING KNIFE DULL OR CHIPPED STATION NO.2 & OR NO. 3 OUT OF POSITION |
| | OPEN | ACCEPT | |
| 110 & 112 | SHORTED | REJECT | BRAID CUTTING KNIFE DULL OR CHIPPED |
| | OPEN | ACCEPT | |
| 112 & 114 | SHORTED | ACCEPT | |
| | OPEN | REJECT | JACKET CUTTING KNIFE DULL |

FIG. 10.

| TYPE OF TEST | TYPE OF FAULT (SEE LISTING) | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 |
| COAX CABLE ALONE | | | | | | | | | | | | | | | | | | | |
| CONTINUITY AT REC. INSPECTION | ✓ | | | | | | | | | | | | | | | | | | |
| SHORT AT REC. INSPECTION | | | | ✓ | | | | | | | | | | | | | | | |
| STRIPPED ENDS OF COAX : | | | | | | | | | | | | | | | | | | | |
| CONTINUITY AFTER STRIPPING | (1) | | | | | | ✓ | ✓ | | ✓ | | ✓ | ✓ | | | | | | |
| SHORT AFTER STRIPPING | | | | (1) | | ✓ | | | ✓ | | ✓ | | | | | | | | |
| CRIMPED CONNECTION | | | | | | | | | | | | | | | | | | | |
| CONTINUITY ON FINISHED JUMPER | (1) | | | | | | (1) | (1) | | (1) | | (1) | (1) | | | | | ✓ | |
| SHORT ON FINISHED JUMPER | | | | (1) | | (1) | | | (1) | | (1) | | | | | | | | ✓ |
| HI-POT ON FINISHED JUMPER | | | | | (3) | (1) | | | (1)<br>(2) | | | | | | | ✓<br>(2) | | | |
| TDR ON FINISHED JUMPER | | (2) | (2) | | (2) | (1) | (1) | (1) | | | (1) | (1) | (1) | ✓<br>(2) | ✓<br>(2) | ✓✓<br>(2) | (2) | ✱<br>✓ | ✱<br>✓ |
| OR | | | | | | | | | | | | | | | | | | | |
| VSWR ON FINISHED JUMPER | | (2) | (2)<br>(2) | | (2) | (1) | (1) | (1) | | | (1) | (1) | (1) | ✓<br>(2) | ✓<br>(2) | ✓✓<br>(2) | ✓<br>(2) | ✱<br>✓ | ✱<br>✓ |

(1) AMBIGUOUS IF PRESENT
(2) DEGREE OF CERTAINTY NOT KNOWN
(3) IF VERY THIN WOULD ALSO BE AMBIGUOUS

✓ – PRIME TEST TO POINT TO CAUSE OF FAULT
✱✓ – COULD BE PRIME
◯ – WOULD ALSO INDICATE FAULT

AUTOMATIC METHOD OF MAKING TERMINATED COAXIAL LEADS

BACKGROUND OF THE INVENTION

1. Field of the Invention

The present invention relates to a system for producing terminated coaxial jumpers and, particularly, an automatic process and apparatus for producing jumpers in quantities, lengths, and configurations according to variable inputs as programmed by an operator.

2. Description of the Prior Art

It has been customary to manufacture coaxial leads or jumpers utilizing assembly line techniques but requiring individual people to perform many of the steps in the process, for example, stripping and trimming the cable, testing the cable, and installing the connectors. Improvements have been made over the years with respect to the tools used by the assembly line personnel. For example, there have been significant improvements in the tools and machinery used to strip and trim the cable, for testing of the cable, and, most notably, for applying the connectors to the cable. Nonetheless, the overall effort remained largely a manual one which, by reason of the human element, resulted in fluctuation in quality and numbers produced.

SUMMARY OF THE INVENTION

It was with knowledge of the prior art and the problems existing which gave rise to the present invention. Specifically, it was desired to substantially automate the process for producing terminated coaxial cable jumpers. According to the invention, a control system is provided which utilizes a microprocessor accepting push button entry of variables such as job identification number, quantity to be produced, jumper length, and jumper configuration. In addition to the control system, the apparatus of the invention includes a feed-measure-cut system for introducing raw lengths of jumpers into the process and a conveyor system for transporting the jumpers in stepped sequence, to a series of work stations which operate on at least one end of each jumper and finally result in completed jumpers. Tests are performed at some of the work stations and those jumpers which fail any of the tests are removed from the process.

The system provides for any and all possible occurrences as a jumper is being produced. It is constructed to react accordingly and to inform an operator of those problems which it cannot solve itself. Thus, by reason of the invention, a labor intensive process has been eliminated resulting in greater output of higher quality jumpers at lower cost and without the problems attendant to the use of personnel on a production line. Such problems as illness, boredom, and the like among production line personnel is well known and can have an adverse effect on the quality and output of a production line. The apparatus and process disclosed is, therefore, a significant improvement in the state of the art of making coaxial cable jumpers.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings which are incorporated in and constitute a part of this invention, illustrate some of the embodiments of the invention and, together with the description, serve to explain the principles of the invention in general terms.

BRIEF DESCRIPTION OF THE DRAWINGS

In the drawings:

FIG. 7 is a detail side elevation view of a stripped end of the coaxial cable diagramatically illustrating tests for electrical continuity;

FIG. 8 is a cross section view taken generally along line 8—8 in FIG. 7;

FIG. 9 is a chart presenting an analysis of stripped end tester results;

FIG. 10 is a chart presenting the types of faults which can occur in terminated coaxial cable leads.

DETAILED DESCRIPTION OF THE PREFERRED EMBODIMENT

The specifications provided below are not intended to be limiting of the invention. Rather, they are intended to be typical and therefore help the reader to better understand the invention. Thus, for example, an automatic machine 20 will be described that operates to cut 75 ohm miniature coaxial cable to the length desired, and strips one or both ends, as desired, in preparation for terminating, that is, installing by way of a compression crimp, associated coaxial contacts on one or both ends of the cable. As presently contemplated, the machine 30 can produce terminated coaxial leads or jumpers in lengths from 9 inches to 120 inches at a rate of 720 per hour for lengths up to 80 inches, de-rated for longer lengths down to 545 per hour for jumpers of 120 inches in length. Additionally, the system is intended to produce any of the following jumper configurations:

(a) male contact on one end of cable
(b) female contact on one end of cable
(c) male contacts on both ends of cable
(d) female contacts on both ends of cable
(e) male contact on one end, female contact on the other end.

Additionally, testing is performed at different stages of the operation following which jumpers are marked as passed or failed, then separated at the outfeed end of the machine.

Figure 1:
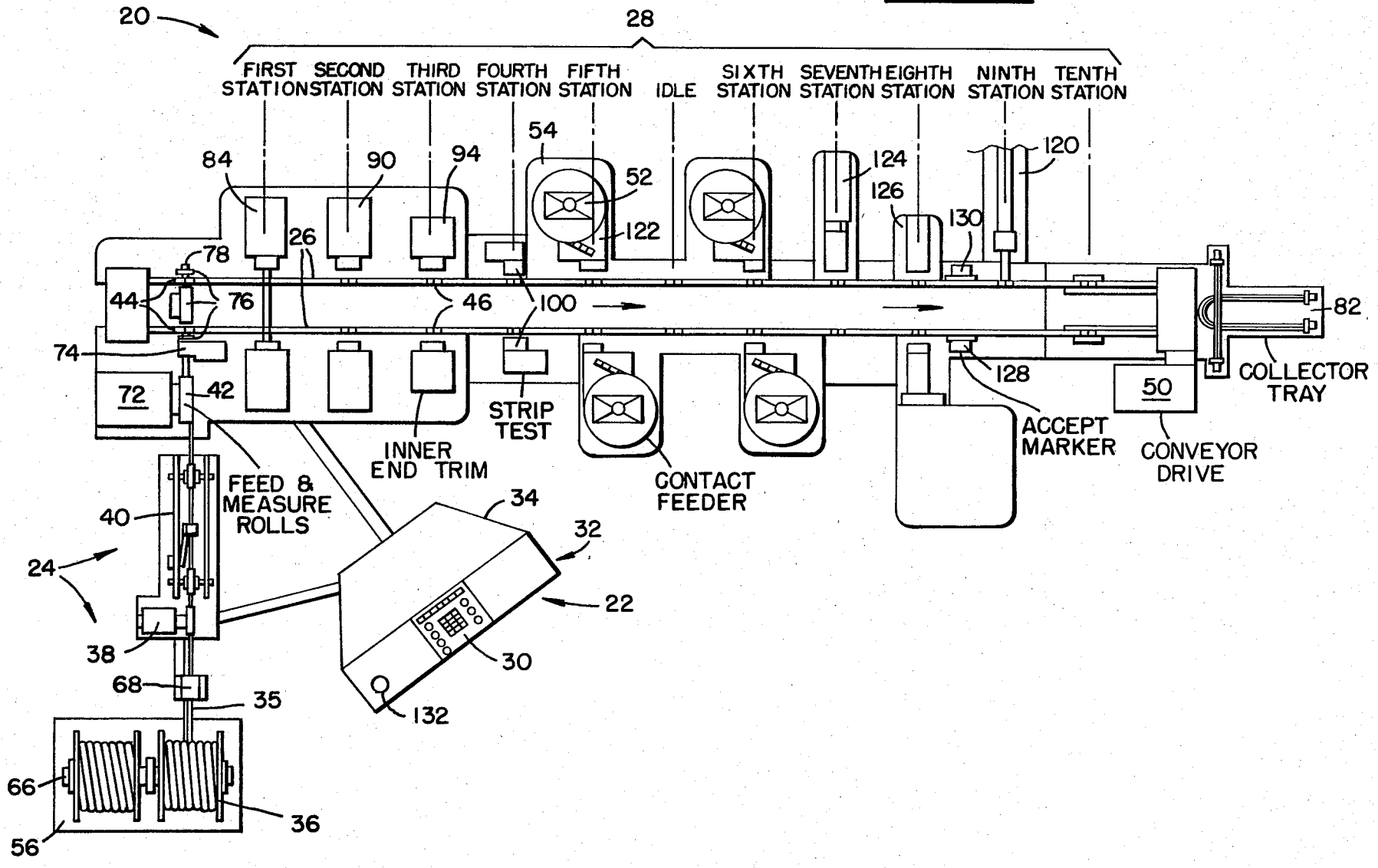
FIG. 1 is a top plan diagrammatic view of a machine embodying the invention.

Turning now to the drawings and initially to FIG. 1, a machine 20 embodying the invention is comprised of four basic units, namely, a control system 22, a coaxial cable feed-measure-cut system 24, a conveyor system 26 and a system 28 of individual work stations spaced along both sides of the conveyor. The control system 22 is a modern, stored program, microprocessor based, machine control unit which contains, in permanent memory, all the functional commands of which the machine 20 is capable. A control panel 30, at a control console 32, allows the operator to enter the variable program requirements of length, quantity, coaxial jumper configuration, and job number identification. A lighted display at the control panel indicates what has been entered. Another section of the control console 32 contains a panel 34 which allows the machine to be operated in jog or set-up modes.

The panel 34 is located on the side of the control console 32 closest to the machine 20. The panel 34 is available for the use of personnel trained in machine servicing, set-up, and trouble shooting. By means of appropriate selector switcher and push button switches at panel 34, the machine 20 can be operated in a jog mode, rather than in a continuous automatic mode. In the jog mode, the conveyor system can be caused to move one station step then stop, or any of the stations can be cycled one or more times independent of the other stations. These controls are extremely useful when the machine is being set up for operation initially or after an adjustment or change has been made at one of the stations. Also at panel 34 is a bank of indicator lights which are connected to sensors located strategically throughout the machine. If a unit of the machine fails to complete its function, the sensor generates a signal to stop the machine and causes its indicator light to be lighted. Each indicator light is labeled with the machine function it represents. This is a considerable time saver in locating a fault in a complex machine of the nature disclosed and is a commonly used technique in the industry.

Although the panel 34 is not shown in detail on the drawing, its configuration can be readily envisioned by the foregoing description.

Considering briefly the feed-measure-cut system 24, coaxial cable 35 is drawn friom a reel 36 by means of a variable speed drive 38. This drive is controlled by a slack loop detector 40 which maintains a low tension supply of coaxial cable to a feed and measure unit 42.

The feed and measure unit 42 comprises rolls which feed the coaxial cable into position in a pair of grip jaws 44 mounted on opposite sides of the conveyor system 26. When the correct length of the cable 35 has been fed into the system, the grip jaws 44 are actuated to grip the cable, and the cable is cut. This procedure is repeated each time a new set of conveyor grip jaws appears at the feed-measure-cut position.

Figure 2:
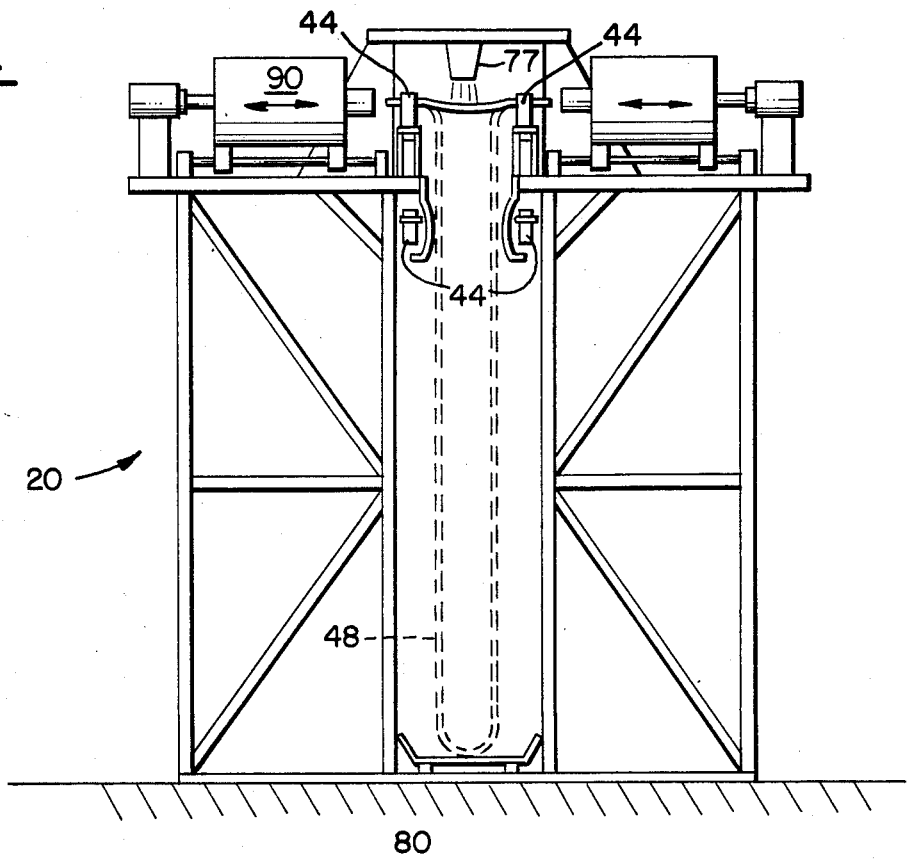
FIG. 2 is an end elevation diagrammatic view of the machine illustrated in FIG. 1.

The conveyor system 26 is composed of two parallel endless heavy duty toothed or webbed belts 46, locked to the teeth of their associated driving and idling sprockets (not shown, but arranged in a customary manner). The belts 46 move in unison with each other. At equally spaced intervals along the belts are mounted the grip jaws 44, one jaw to grip the leading end of the coaxial cable, the other to grip the trailing end. A short length of the coaxial cable protrudes at the work station sides of the grip jaws so that the required operations can be performed on the cable ends. The remaining length of the cable extends down between the grip jaws in the form of an elongated "U", a coaxial jumper being designated by the reference numeral 48 (see FIG. 2).

It will be appreciated that a complete cycle for making a coaxial jumper on the machine 20 is composed of twelve steps including one wire load step, ten station steps, and one idle step. The step distance from station to station, and the pitch distance from one grip jaw 44 to the next succeeding grip jaw 44 along the timing belts 46 are equal. A conveyor drive mechanism 50 indexes the timing belts 46 one pitch distance for each cycle step of the machine 20.

Along the leading end and trailing end sides of the conveyor system 26 are located the work stations collectively represented by the reference numeral 28. Six of the work stations are devoted to stripping and trimming of the coaxial cable, two stations to strip testing, four stations to contact installation, four stations to final testing, two stations to failed jumper removal, and two stations are devoted to completed jumper outfeed. Two marking stations perform their functions on the coaxial cable 35 as it moves between stations.

The work stations, or a part of a work station, are moved toward and away from the conveyor timing belts 46, thus enabling them to engage an end of the coaxial jumper 48 for the work to be performed. For some stations, the action is an opening and closing movement. Thus, the stations have the ability to do their work on the jumper end and then retract out of the way, allowing the jumper end to move in an unobstructed manner to the next station.

The following basic functions are intended to be performed by the machine 20 as a part of its repetitive cycling operation:

(a) Prefeed the coaxial cable 35 from reels 36.

(b) Maintain a slack loop ahead of the feed and measuring rolls 42 to achieve accurate cable measuring and minimum stress on the cable.

(c) Sense the leading end of the cable from the reel, shut down the machine 20, and signal the operator to load a fresh reel of cable.

(d) Sense knots or kinks in the cable, shut the machine 20 down, and signal the problem to the operator.

(e) Measure and feed the required length of cable as called for by the program input.

(f) Cut the cable 35 to a predetermined length.

(g) By means of the conveyor system 26, transport a jumper 48 to all operating stations of the machine 20 in a sequential stepped manner to the position at which the completed coaxial jumper 48 is fed out of the machine 20.

(h) Strip one or both ends of the cable, as programmed, to prepare it for proper crimp termination into appropriate coaxial contacts.

(i) Inspect the stripped ends of the cable to determine correct stripping and register an "accept" or "reject" decision.

(j) Feed female and male contacts to the contact insertion stations of the machine 20.

(k) Crimp install contacts on the ends of the coaxial cable in one of the following configurations, as determined by the program input:

*Male contact on one end of cable.

*Female contact on one end of cable.

*Male contacts on both ends of cable.

*Female contacts on both ends of cable.

*Male contact on one end, female contact on the other end of the cable.

(l) Electrically test each completed coaxial jumper 48 of the last three configurations presented in Item (k) and register an "accept" or "reject" decision.

(m) Mark each accepted coaxial jumper 48 with a suitable mark to indicate acceptance.

(n) Mark each rejected coaxial jumper 48 with a suitable mark to indicate rejection.

(o) Deposit the accepted coaxial jumpers 48 at one location at the outfeed end of the machine 20. Deposit rejected coaxial jumpers at another location.

The cycle rate for the machine 20 can be readily determined. Typically it would take one second for conveyor timing belts 46 to move from one station to the next; three to four seconds for the longest dwell required at a work station; and a twenty five inch per second average feed rate for the coaxial cable. Thus, it follows that for jumpers up to 80 inches in length, with the station dwell set at four seconds, the cycle rate will be five seconds or 720 completed jumpers per hour.

Above 80 inches in length the cycle rate will increase by one second for each additional 25 inches of cable fed into the system. At 120 inches length, then, the planned output would be 545 completed jumpers per hour. Hoppers 52 of the contact part feeders 54 allow for reloading while the machine 20 is operating. Thus, there is no down time for this activity. With a fresh reel of cable ready at a two-position reel holder 56, down time for reloading cable is reduced considerably. Experience has shown that this can be accomplished in three minutes or less.

Reprogramming at the control console 32 for variables including a different jumper configuration, length, quantity, and a job number should be accomplished in two minutes or less.

Figure 3:
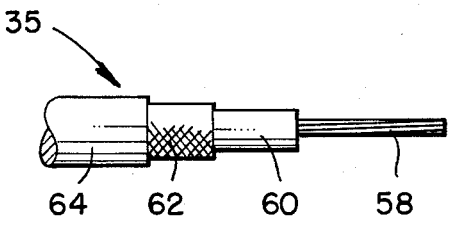
FIG. 3 is a detail side elevation view of a stripped end of a length of coaxial cable of the type operated on by the machine of the invention.

FIG. 3 illustrates one end of a typical form of the coaxial cable 35, and presents dimensions therefor, specifically for 75 ohm coaxial cable. The cable 35 includes an inner conductor 58, an inner insulator 60, an outer conductor or braid 62, and an outer insulator 64. Typical contacts used to terminate the ends of the individual jumpers 48 are subminiature coaxial contacts manufactured by Burndy Corporation under the trademark MONOCRIMP catalog number RMDX60-46D28 and RCDX60-16D28. Such contacts are also shown in Burndy Catalog "The Connector Selector" Reorder No. 1020 [Electro-MC-32084-WP (50M)]. The individual units comprising the machine 20 will now be described in greater detail.

Returning to FIG. 1, the first element of the coaxial cable feed-measure-cut system is the reel holder 56 which holds a pair of reels 36 from which coaxial cable 35 is drawn. A fresh reel is positioned beside the actively feeding reel, ready to feed when the actively feeding roll is fully depleted. When the reel being used runs out, the machine 20 stops operation momentarily. The operator turns the reel holder 56 180° about a vertical axis, manually feeds in the wire from the fresh reel, and starts up the machine again. While the machine 20 is operating, the operator removes the empty reel and places a fresh one on a vacant arbor 66, ready for the next reload. This arrangement minimizes down time for cable reloading.

A cable guide and end/knot detector 38 immediately follows the reel 36 in the operation of the machine 20. It assures smooth pay out of the cable from the reel. Utilizing commercially available components, it detects the end of the coaxial cable as it leaves the reel 36 and initiates a shut down signal, causing the machine to cease its operation until a fresh reel is moved into position. It also detects a knot or kink in the cable 35 and initiates a shut down signal, similarly causing the machine 20 to cease its operation until the problem has been corrected. After leaving the cable guide and end-/heat detector 66, the cable 35 is operated on by the variable speed drive mechanism or pre-feeder 38 which pre-feeds the coaxial cable to the slack loop detector 40. The pre-feeder 38 operates to minimize pulling force in removing the cable 35 from the reel 36. For its part, the slack loop detector 40 serves to control the pre-feeder 38. To this end, it maintains a slack loop of cable 35 so as to provide a low, nearly constant, back pressure or tension to the feed and measure rolls 42 which follow next in the process. The rolls 42 are driven by a stepping motor 72. The rolls 42 and associated pressure rolls are shaped to fit the outer diameter of the cable 35 and are surfaced to achieve no slip engagement with the cable. The stepping motor 72 and its indexer are controlled by the control system 22. Feed length output of this system is preferably controllable in 0.10 inch increments. The rolls 42 feed the cable to the initial length at a cut-off 74 as directed by the control system 22 for an individual jumper 48.

The cut-off 74 serves to cut the coaxial cable 35 to the initial length required. Since both ends of the cable will be trimmed at a subsequent stage in the process, these two end trims must be accounted for. The control system will add the two end trim lengths to the desired length, or programmed length, to obtain the initial length. Opening cable guides 76 overlie the timing belts 46 and guide the coaxial cable 35 into position for gripping by the conveyor cable grip jaws 44. The guides 76 open to enable feeding of the cable to the initial length and to allow the conveyor gripped cable to move out of this station. The jumper 48 is held in position for a brief interval while air jets from suitable nozzles 77 (FIG. 2) mounted on the structure of the machine 20 start the cable down between the conveyors into the "U" shaped loop illustrated in FIG. 2. A final element at the first station is a leading end sensor 78 which senses the leading end of the coaxial cable 35 and triggers actuation of the leading end cable grip jaws 44 for proper leading end placement.

The conveyor system 26 transports the coaxial cable 35 from start to finish, from station to station of the machine 20. As previously described, the conveyor is composed of two continuous belts 46, one belt handling the leading end (or first end) of the jumper 48, the other belt handling the trailing end (or second end) of the cable. See FIG. 2.

The belts are of the heavy duty toothed or webbed type. A typical composition is polyurethane, reinforced with two continuous stranded stainless steel cables. The back side of each belt meshes very closely with toothed pulleys, both drive and idling pulleys, eliminating slip and providing near zero backlash.

The cable grip jaws 44 are secured to the belts at a spacing equal to the station to station spacing of the machine 20. Additionally, each of the cable grip jaws is self-powered so that they can be independently opened and closed by electrical impulse at any station position.

The conveyor system 26 receives "GO" commands from the control system 22. At each "GO" command, the timing belts 46 are moved one station to station space toward the outfeed end of the machine 20 adjacent the conveyor drive mechanism 50. Attention is given to acceleration and de-acceleration of the conveyor system 26 so as to achieve a smooth movement of the belts 46. The belts move in unison with each other since their drive and idler pulleys are locked to common shafts.

The conveyor belts 46 and their cable grip jaws 44 are spaced apart a distance slightly less than the minimum length coaxial jumper. Thus, even the minimum length jumper will have a small slack loop to insure there is no stretching force exerted on the cable as it moves down the conveyor. Longer lengths of cable are then caused to loop down between the conveyors by an air jet directed from the nozzle 77 (FIG. 2) as noted above. As shown therein, a longitudinally extending tray 80 having a low friction, protective surface is provided at floor level under the conveyor system for the loop of long jumpers to slide on.

At the outfeed end of the conveyor system 26, completed and accepted jumpers 48 are deposited on a collector tray 82.

Those positions along the machine 20 at which the conveyor belts 46 momentarily stop to enable an operation to be performed on a jumper 48 are denoted "first station", "second station", etc. and are so indicated on FIG. 1. The first three station positions along the machine 20 are devoted to stripping and end trimming of the coaxial cable 35. These stations are identical on the leading end and trailing end sides of the conveyor system 26. See FIG. 1. An explanation of their functions follows in conjunction with FIGS. 4, 5, and 6.

Figure 4:
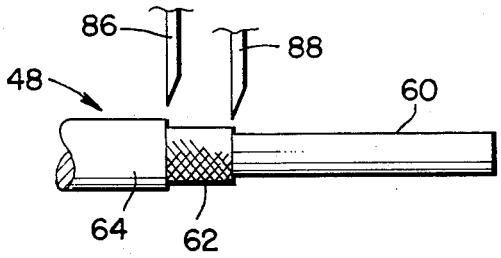
FIGS. 4, 5, and 6 illustrate successive steps of stripping the coaxial cable by the machine of the invention.

Consider initially the first stripping operation performed at the first station (FIG. 1), as schematically illustrated in FIG. 4. A stripping head 84, one positioned on either side of the conveyor system 26, moves toward its associated conveyor belt 46 when it is activated so as to insert one end of the coaxial cable into its stripping mechanism. Funnel entry at the face of the stripping head 84 guides the end of the jumper into place. The stripping head then stops and is positively held in proper position on the cable for the stripping cuts. Cable clamps, which are an integral part of the stripping head, are then activated. These clamps grip the cable between the conveyor grip jaws 44 and the face of the stripping head 84.

Each end of the jumper 48 is contained within a close free-fit support bushing inside the stripping head 84, is gripped by the stripping head grippers, and is additionally gripped by the conveyor grip jaws 44. Thus, the end of the jumper is completely supported for the stripping action and is held so as to prevent any rotational or longitudinal movement. The support bushing and cutter blade components of the stripping head 84 are then rotated about the end of the jumper 48. Slots in the bushing allow for entry of a first cutter blade 86 to the proper depth for cutting through the outer insulation 64 and for a second cutter blade 88 to cut through the outer insulation 64 and the braid 62. Cut depth is accurately controlled by blade stops. The ratio of tangential velocity at the cut to penetration depth velocity is high, thus imparting a gradual "sliding cut" action. This type of stripper cutting action imparts the least damage to the cable and provides the cleanest strip cuts of any stripping mechanism known today.

The stripper head grippers then open, the stripper head moves back off the end of the jumper 48 while the cutter blades hold at position, and the strip slugs are pulled off the jumper. The blades 86 and 88 then fully retract, the slugs are pushed out of the head by a pusher pin, and a vacuum exhaust is actuated to carry away the slugs and any wire bits which are present.

Figure 5:
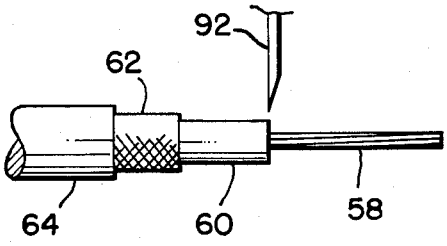
Figure 6:
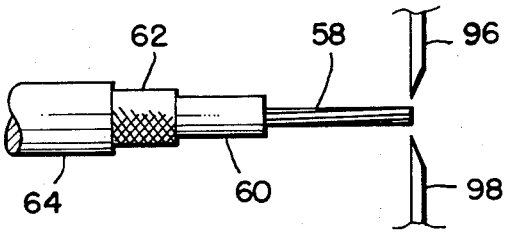

At this second station, construction of a stripping head 90 is similar to that of the stripping head 84. Also, the action is very similar to that performed at the first station except that here the inner slug of insulation 60 is removed as shown in FIG. 5. Only one cutter blade 90 is required for this function.

Figure 6A:
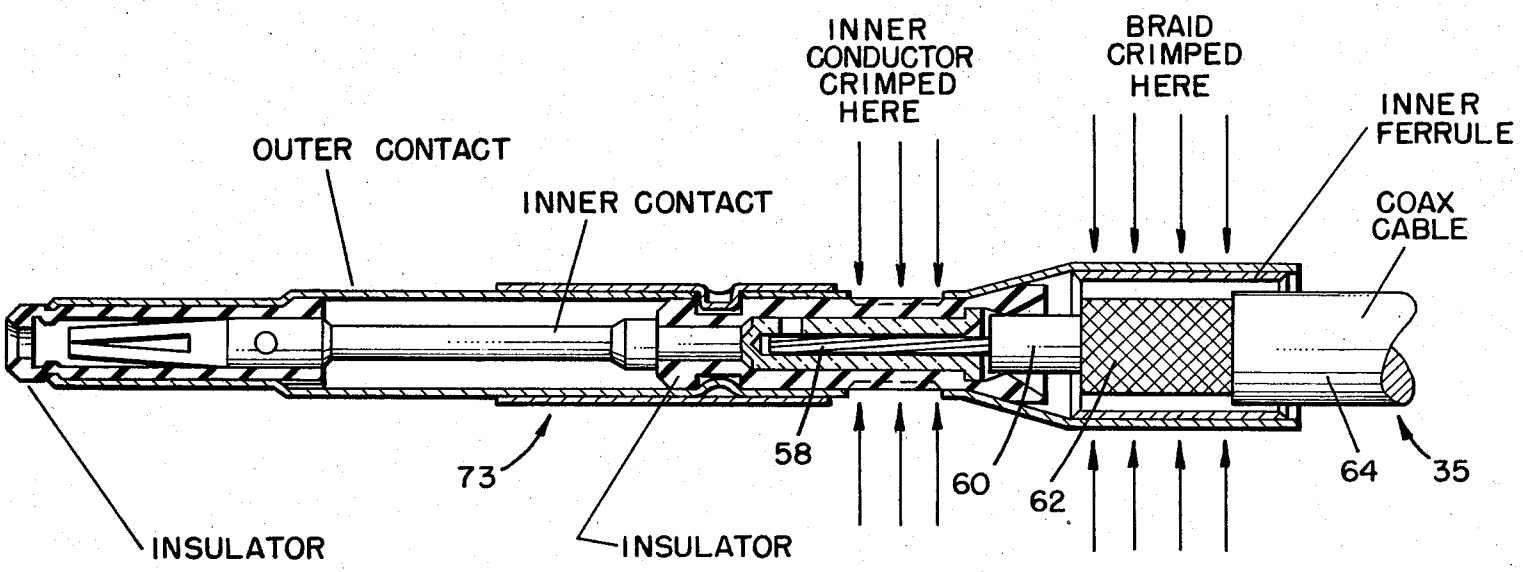
FIG. 6A is a side elevation view in cross section illustrating a terminated end of a jumper.

At the previous stations, the inner conductor 58 was not accessible to achieve a clean, burr free, cut. This is because, in each instance, it was still surrounded by the inner insulator 60, which is a soft resilient material offering very little support to the conductor 58 for the cutting action. At the third station (see especially FIG. 6), the inner conductor is readily available for a clean cutting operation. Approximately 0.06 inch are trimmed off both ends of the inner conductor 58 at this station by means of a trimming head 94 which is generally similar to the stripping heads 84 and 90. The cutting is accomplished by the use of two opposed "V-Notch" cutter blades 96 and 98. The resulting cut imparts a slight reduction in diameter at the tip of the inner conductor, thus assisting in subsequent insertion into the inner conductor of the contact 73 (see FIG. 6A). Vacuum exhaust is again used to remove all trimmed wire bits.

After the trim cut performed at the third station (FIG. 6), all strip lengths on the ends of the jumper will be to proper lengths. The amount removed by a trim cut will have been accounted for previously at the first station, and at the second station. The "programmed length" of the jumper will meet requirements nonetheless because the control system 22 will have added a constant for two trim lengths to the programmed length in determining the initial length.

It is highly recommended that all coaxial cable to be processed by the machine 20 be 100% tested for continuity for the inner conductor 58, continuity of the braid 62, and no shorting of inner conductor to the braid, before it is brought to the machine 20 for processing. Although the incidence of these type of faults may be extremely small, this is never known unless the tests are performed. Indeed, if these tests are not performed, a degree of ambiguity will be introduced at the in-process testing performed by the machine 20.

At the fourth station (see FIG. 1) are located a pair of after stripping testers 100. FIGS. 7 and 8 help explain the operation of the testers. A tester 100, as illustrated, is positioned at the leading end and at the trailing end of the jumper 48. Each tester 100 contains seven sets of conductive contactors identified by numerals 102 through 114, respectively. Contactor 102 is of one piece construction which serves only to detect the end of the inner conductor 58 in the event it exceeds the desired length. Each set of the remaining contactors, viewing FIG. 8, includes an upper member 116 and a lower member 118 which are coplanar and matingly encompass the cable at each particular location illustrated in FIG. 7. All contactors are isolated from each other by insulation.

The purpose of each of the contactor sets is as follows:

| Contactor Set | Purpose |
|---|---|
| 102 | Detect that the inner conductor 58 is too long. |
| 104 | Detect that the inner conductor 58 is long enough. |
| 106 | Detect that the inner insulation does not extend too far. |
| 108 | Detect that the inner insulator 60 is long enough. |
| 110 | Detect that the outer conductor 62 is cut short enough. |
| 112 | Detect that braid is long enough. |
| 114 | Detect that the outer insulator 64 is cut back far enough. |

As the stripped ends of the jumper 48 move to the fourth station, the testers 100 are open so as to offer no obstruction. When on station, the tester halves, that is, the upper member 116 and lower member 118, move together, the natural funnel action of the upper tester half centers the stripped cable within the tester. The test is made by applying a DC voltage to certain contactors and detecting continuity or the absence of continuity at other contactors sets. For example, if there is a flow of current between contactor sets 102 and 104, that indicates that the strands of the inner conductor 58 are too long and were not properly trimmed at the third station. Similarly, if there is current flow between contactor sets 112 and 114, the braid 62 is of the proper length. These tests are fully defined in the table presented in FIG. 9. As the table shows, a detected fault can point to the stripping station and the stripping component which is suspect as being the cause.

A jumper 48 which does not pass the after stripping tests will not be processed at the subsequent stations of the machine 20. The control system 22 will follow that particular jumper down the conveyor system 26 and shut each station off when that particular jumper is on station. The rejected jumper will be fed out into the reject bin 120 at the ninth station.

The fifth and sixth stations along the conveyor system 26 perform the function of crimp installing the contacts 73. As shown in FIG. 1, male contacts are crimp installed to the leading and trailing ends of the jumper 48 at the fifth station and female contacts are installed to the leading and trailing ends of the jumper at the sixth station. One description for all four mechanisms will suffice since they differ only as to the application of a male or female contact. The contacts 73 are fed by the vibratory hopper 52 to each crimping head 122. The contacts 73 are bulk fed into the hoppers, which maintain a relatively low level of contacts in a vibratory feed bowl. The feed bowl is preferably Teflon lined to minimize any wear action on the contacts. The contacts discharge from the bowl into a feed track. When the feed track fills to a nearly full point, the vibratory action of the bowl is shut off. When the feed track empties to a predetermined level, the vibratory action is turned on. The combination of Teflon coating, low level in the bowl, and limited bowl vibration, has been shown by experience to render minimal contact wear or damage.

An escapement takes one contact at a time from the feed track and places it into a contact positioner of the crimping head. The crimping head 122 is moved toward it associated conveyor belt 46 the required distance to properly insert the coaxial wire into the contact 73. Positioners which accurately align the coaxial jumper end to the crimping head, and funnel lead-ins which guide the stripped cable into the contact, guard against any bent back strands during this operation.

The crimping head 122 is locked in position with the contact in proper position on the cable end, and the crimp mechanism of the head is actuated. Four indentors for the inner crimp and four indentors for the braid crimp are advanced inward by cam mechanism and are brought to the required full crimp position. Butting features on these indentors assure that the crimp depth is controlled extremely accurately.

Reverse actuation of the crimping head 122 next takes place. The lead-ins and the indentors open to clear the installed MONOCRIMP contact. The crimp head then moves to its original position away from the conveyor so as to fully clear the contact when the conveyor moves the jumper to the next station.

This contact installation procedure is repeated each time the conveyor brings a coaxial jumper 48 on station and the crimping head receives an actuate signal from the control system 22. For jumpers with a contact on both ends, one crimping head on the leading end conveyor side and one crimping head on the trailing end conveyor side will be activated. Whether male or female style contacts are to be installed will be determined by the program entered at the control console 32. For jumpers 48 with a contact on one end only, three of the crimping heads 122 will be inactive; only the one chosen by the program will be active.

A high voltage tester is located at the seventh station. Contactors, insulated from each other, will move in at one end of the completed jumper 48 and contact the inner contact and the outer contact, respectively, of each contact 73. An AC voltage will be applied across the inner and outer contacts and the resulting leakage current will be measured. Leakage in excess of a programmed limit, for example five micro amps, will cause rejection of the jumper assembly.

As seen from a table presented in FIG. 10, this test is a prime indicator of a crimp which is too tight. A crimp which is too tight typically ruptures the contact insulator and allows the outer contact to short circuit to the inner contact. Testing and evaluation must be conducted to determine the voltage level at which this test will be applied.

A final test position, a high frequency tester 126 at the eighth station, examines the jumper 48 for its electrical characteristics using high frequency techniques, closely approximating its actual operating conditions. The goal of this test station is to determine that the conductor on each end of the jumper is properly installed and crimped, and that the jumper is able to transmit pulses without excessive distortion or noise being added.

There are two possible approaches. One is to use time domain reflectometry (TDR). The other uses swept frequency techniques and evaluates voltage standing wave ratio (VSWR), reflected power, or similar criteria. The time domain reflectometry approach offers direct measurement of cable parameters and the ability to locate faults longitudinally. However, this equipment is costly, its reliability under factory conditions is currently being established, and its ability to identify faults, such as improper crimping, has yet to be fully proven. The sweep technology uses less costly and complex equipment, but can be difficult to interpret. Also, its ability to define faults has not been proven, and it offers no longitudinal definition. Reliability under factory conditions is also unproven. In any event, the machine 20 is equipped to incorporate at its eighth station such state of the art testing apparatus as becomes available.

Immediately below is a listing of 19 possible faults that could occur in a completed coaxial jumper. These possible faults are listed in three groups; those present on the coaxial cable before it is processed, those contributed by the stripping action, and those occurring in the crimped connection.

POSSIBLE FAULTS IN TERMINATED COAXIAL JUMPER

Coaxial Wire Alone

1. BROKEN INNER (OPEN) CONDUCTOR.
2. BROKEN INNER (SOME STRANDS) CONDUCTOR
3. BROKEN BRAID (SOME STRANDS).
4. INNER CONDUCTOR SHORTED TO BRAID.

5. INNER INSULATOR OPEN OR THINNED BADLY.

Stripped Ends of Coaxial Jumper

6. INNER CONDUCTOR SHORTED TO BRAID.
7. INNER CONDUCTOR NOT STRIPPED.
8. BRAID NOT STRIPPED.
9. SOME OR ALL BRAID STRANDS CUT TOO LONG.
10. OUTER INSULATOR STRETCHED; EXPOSED BRAID TOO SHORT TO GET CRIMP CONTINUITY.
11. INNER STRANDS TOO LONG. MISPOSITIONS WIRE IN CRIMP BAD ENOUGH TO CAUSE FAULT.
12. INNER STRANDS TOO SHORT DUE TO CUT-OFF.
13. INNER STRANDS TOO SHORT DUE TO STRETCHED INNER INSULATOR
14. ONE OR MORE INNER STRANDS CUT & MISSING.

Crimped Connection

15. INNER CRIMP TOO LOOSE, CRIMP JOINT RESISTANCE HIGH OR VARIABLE.
16. INNER CRIMP TOO TIGHT, CONTACT INSULATOR THINNED OR RUPTURED.
17. BRAID CRIMP TOO LOOSE, CRIMP JOINT RESISTANCE HIGH OR VARIABLE.
18. OPEN (NO CONTACT) CRIMP AT INNER AND/OR BRAID.
19. INNER CONTACT SHORTED TO OUTER CONTACT.

The table presented in FIG. 10 lists various test types and identifies the type of test which would be the prime test to point out a specific fault. In order to keep the type of automatic equipment disclosed herein producing reliably and efficiently, it is necessary to correctly locate the cause of a fault so as to get to the source and correct it quickly. The table shows that unless the testing is accomplished in a planned order, the results can be ambiguous, that is, several things could be suspected as the cause or source of a problem. For example, a broken inner conductor 58 which was present in the original coaxial cable 35 could be suspected as due to the stripping or as due to the crimping. Or, the inner conductor 58 shorted to the braid 62 by stripping could be suspected as caused by the crimp. The goal of the on-line testing by the machine 20 will be to identify the faults at the time and place where their cause or source can be identified.

The control system 22 maintains a record of rejections due to testing. A run of two cables in succession failing the same test causes the machine to stop and summon the operator. Failure of two cables in any run of ten will also cause the machine to stop. These quantities can be programmed and can be changed as experience is gained. Rejected cables are not counted. The machine will deliver the programmed quantity of fully accepted cables. It is intended that a count will be maintained of all rejects by category. This information would then be available when a job is completed.

Between the eighth and ninth stations along the conveyor system 26 are located accept and reject markers, 128 and 130, respectively. A suitable marking ink is preferably utilized, it being proposed that acceptable coaxial jumpers be marked in green, and jumpers which did not pass the tests of the seventh and eighth stations be marked in red. A forced air drying assist can be provided if needed. The pass or fail decision from the seventh and eighth stations are stored in the control system 22 and recalled so that when the respective jumper passes the markers, one or the other will be activated as appropriate. The mark may, for example, be a band approximately $\frac{1}{4}$ inch wide on one side of the coaxial cable immediately adjacent the installed contact.

After marking is accomplished, any rejected jumpers are removed at the ninth station. Again, the results from the seventh and eighth stations will be used to activate the ninth station when the jumper that failed reaches the ninth station. Several techniques can be used for accomplishing this result. One method would make use of a vacuum tube. The conveyor grip jaws 44 would open and the jumper 48 would be drawn down the tube and into a receptacle. Another would use soft feed rolls which would close on one end of the jumper. The grip jaws would open, and the jumper would be carried away down a chute into a receptacle. A primary objective of the method used is to prevent damage to the jumper so that it can be salvaged and repaired if practical.

At the tenth station of the conveyor system 26, the completed jumpers are released from the grip jaws 44 and fed out into a readily accessible position for removal. Different methods can be utilized for this operation. According to one preferred construction, as illustrated in FIG. 1, the conveyor grip jaws 44 open at the tenth station. The jumpers are deposited on a secondary conveyor and carried out to an inclined tray 82, short jumpers being deposited in a straight configuration, longer jumpers in the form of an elongated "U".

The control system 22 sequences the safe and correct operation of the machine 20 without operator attention except to load cable 35 and connectors 73. The system recognizes faulty operation, stops the machine 20, provides an appropriate indication of why it stopped, and alerts the operator. In addition it provides a convenient means to maintain and troubleshoot the machine 20. Finally, the operator is able to quickly program different coaxial jumper configurations, lengths, and quantities. The control system utilizes modern stored program microprocessor based hardware suitable for an industrial environment.

The control system 22 has two modes of operation: normal and test. In the normal mode, the machine 20 may be set up by the operator and run. The test mode includes the maintenance and troubleshooting functions. The following chart will clarify the modes of operation:

| MODE | FUNCTION | RESULT |
|---|---|---|
| NORMAL | RUN | Machine 20 makes jumper assemblies. |
| | Program | Operator programs assembly to be made. |
| | Run One | Machine 20 makes a sample jumper assembly. |
| TEST | Machine 20 may be jogged as required to allow maintenance and troubleshooting. | |

Mushroom head emergency stop buttons of the type indicated by a reference numeral 132 at a corner of the console 32 are located conveniently around the machine 20. One such button is illustrated on the control panel 30. Pressing any one of these will stop the machine 20 instantly. All buttons must be pulled out for the machine to operate. In addition, various safety switches are provided to prevent operation unless guards and covers are properly in place.

Figure 11:
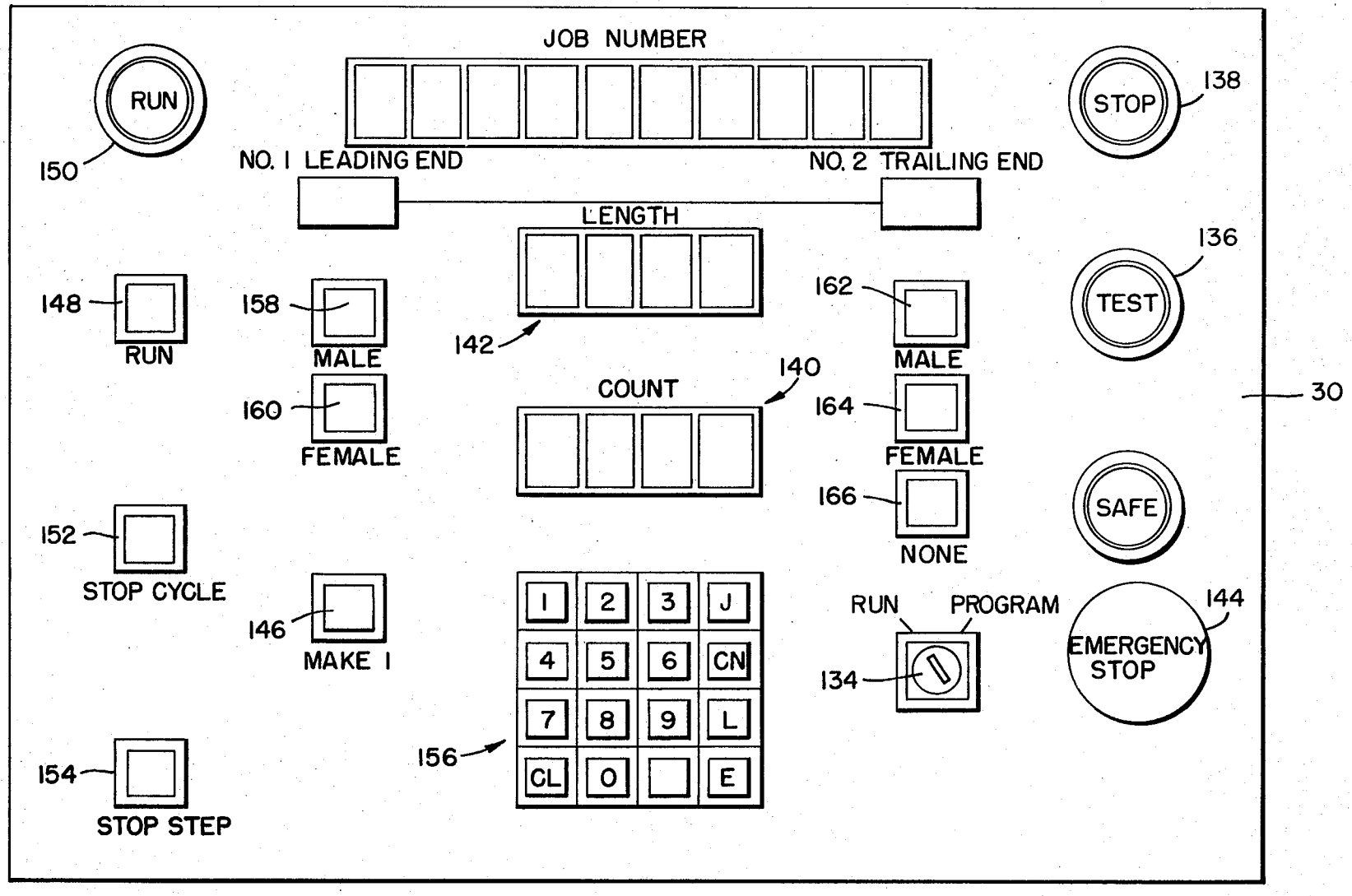
FIG. 11 is a plan view of a control panel utilized by the machine of the invention.

The control panel 30 provides the means to program and to operate or stop the machine 20. See FIG. 11 which illustrates the layout of the control panel 30. The functions of each control and indicator are defined, and the sequencer of steps to make a jumper assembly are shown below:

CONTROLS/INDICATORS AND THEIR FUNCTIONS

Run/Program Switch 134—Key operated switch Run=Normal Operation Program=Change configuration, length, quantity, or job number.

Test Indicator 136—On when in Test Mode. Operator Panel cannot control operation.

Stopped Indicator 138—On (Red) when machine 20 has stopped at end of count. Flashes when machine 20 stops for lack of cable or connectors, test faults, etc.

Count Display 140—Shows number of assemblies still to be made. (Maximum: 9999)

Length Display 142—Shows cable length in inches and tenths. (Range: 8.0 to 120.0)

Safe Indicator 144—On (Green) when one or more Emergency Stop buttons 132 are activated and it is safe to work on machine 20.

Emergency Stop Button 132—When pushed stops machine 20 instantly, must be pulled to reset.

Make One button 146—Pressing this button while switch 134 is in the Run position causes the machine 20 to make one cable assembly complete.

Run Button 148—Pressing this button puts machine 20 in normal continuous cycling operation.

Run Indicator 150—Illuminated when machine 20 is running normally.

Stop Cycle Button 152—Pressing this button causes machine 20 to cut no more cable, but to complete all cables already cut (Illuminated Yellow).

Stop Step Button 154—Pressing this causes machine 20 to complete the functions of each station, but not advance to next station (Illuminated Red).

Key Pad 156—Used to enter Job, Quantity, and Length.

Connector Selection—Under each end connector are Buttons 158, 160, 162, buttons. These allow selection of a male (158) or female (160) contact on the number 1 end, and selection of a male (162), female (164), or no (166) connector on the number 2 end. Push-buttons are momentary, but selection chosen is illuminated.

Job Number Display—Shows the particular production job number which the number which the machine 20 has been programmed to produce.

No. 1 Leading End and No. 2 Trailing End—Displays M if a male has been selected, F if a female, and N if none.

Buttons J, CN, L—Address the job number location in the computer controller memory.

J—Used to put job number into program memory.

CN—Used to put total count desired into program memory.

L—Work to put length into program memory.

Button E—Must be activated (depressed) to enter the J, CN, or L selection into program memory.

Button CL—When depressed after J or CN or L, will clear the memory of any entity.

The following sequence of steps is performed when it is desired to program a different jumper assembly:

1. Turn switch 134 to PROGRAM
2. Press COUNT (CN) then CLEAR (CL). (Count display will go to zero).
3. Press desired quantity on KEYPAD. (If an error is made, press CLEAR and re-press Keypad. Use this system for clearing errors in following steps).
4. Press ENTER (E). (New count will be displayed.)
5. Press LENGTH (L), then CLEAR. (Job display will go to zero.)
6. Press desired length on KEYPAD.
7. Press ENTER. (New length will be displayed.)
8. Press JOB (J) then CLEAR. (Job display will go to zero.)
9. Press desired Job Number on KEYPAD.
10. Press ENTER. (New Job Number will be displayed).
11. Select No. 1 end connector by pressing desired button under No. 1 end.
12. Likewise select No, 2 end connector.
13. Turn key switch to RUN.
14. Press RUN. (The machine 20 will commence produciong the programmed jumper assemblies.)
15. If it is desired to make one sample for check out before producing the lot, then at step 14 MAKE ONE would be depressed. One jumper assembly will be processed thru all stations of the machine 20.

The following procedures are performed to stop the machine in different situations:

(a) In an Emergency—Press any mushroom head Emergency Stop button 132. Machine 20 will stop immediately.

(b) At end of next step—Press Stop Step. Machine 20 will complete that step and stop.

(c) After finishing cables in process—Press Stop Cycle. Machine 20 will cut no more cable and will finish all cables in process.

While the preferred embodiments of the invention have been disclosed in detail, it should be understood by those skilled in the art that various modifications may be made to the illustrated embodiments without departing from the scope thereof as described in the specification and as defined in the appended claims.

What is claimed is:

1. An automatic process for producing terminated coaxial cable jumpers in a predetermined quantity to predetermined lengths and with predetermined end styles comprising the steps of:

feeding coaxial cable having inner and outer conductors and inner and outer insulation from a reel in the direction of a free end so that it forms a U-shaped loop extending away from the free end;

measuring the length of the cable extending from the reel;

gripping the cable at a first location proximate to but spaced from the free end;

when a predetermined length of the cable has been reached, gripping the cable at a second location distant from the free end;

severing the cable from the spool at a location spaced from the second location in a direction away from the free end to thereby form a jumper of predetermined length;

stripping at least one end of the jumper to expose predetermined lengths of the inner conductor and the outer conductor thereof;

testing the stripped jumper to determine whether it meets preestablished standards; and rejecting a jumper which fails to meet the preestablished standards.

2. An automatic process as set forth in claim 1 wherein the step of stripping at least one end of a the jumper includes the steps of:

advancing the jumper to a first station in a direction transverse of a plane containing the jumper; and at the first station, stripping from the end of the jumper a predetermined length of the outer insulation to thereby expose a similar length of the outer conductor and simultaneously stripping a predetermined length of the outer conductor to thereby expose a similar length of the inner insulation.

3. An automatic process as set forth in claim 2 wherein the step of stripping at least one end of the jumper includes the additional steps of:

advancing the jumper in the transverse direction to a second station; and at the second station, stripping from the end of the jumper a predetermined length of the inner insulation to expose a similar length of the inner conductor.

4. An automatic process as set forth in claim 3 wherein the step of stripping at least one end of the jumper includes the additional steps of:

advancing the jumper in the transverse direction to a third station; and at the third station, trimming the end of the exposed inner conductor to a predetermined length.

5. An automatic process as set forth in claim 4 including the steps of:

advancing the jumper in the transverse direction to a fourth station; and at the fourth station, testing the stripped jumper for electrical continuity of the inner and outer conductors.

6. An automatic process as set forth in claim 4 including the steps of:

advancing the jumper in the transverse direction to a fifth station; and at the fifth station, installing a male contact to the stripped end of the jumper, the contact having an inner contact element electrically joined with the inner conductor and an outer contact element electrically joined with the outer conductor.

7. An automatic process as set forth in claim 4 including the steps of:

advancing the jumper in the transverse direction past a fifth station to a sixth station; and at the sixth station, installing a female contact to the stripped end of the jumper, the contact having an inner contact element electrically joined with the inner conductor and an outer contact element electrically joined with the outer conductor.

8. An automatic process as set forth in either claim 6 or claim 7 including the steps of:

advancing the jumper in the transverse direction to a seventh station;

at the seventh station, applying a voltage across the inner and outer contact elements establishing a maximum level of leakage of electrical current resulting from the application of the voltage across the inner and outer contact elements; and rejecting a jumper having a contact from which the leakage of electrical current exceeds the maximum level.

9. An automatic process as set forth in claim 8 including the steps of:

advancing the jumper in the transverse direction to an eight station; and at the eight station, examining the jumper for its electrical characteristics using high frequency techniques.

10. An automatic process as set forth in claim 9 including the steps of:

advancing the jumper in the transverse direction towards a ninth station;

before reaching the ninth station, marking the jumper as accepted in the event it passes the tests performed at the seventh and eighth stations;

advancing the accepted jumper in the transverse direction past the ninth station to a tenth station;

at the tenth station, ungripping the jumper; and feeding the jumper to a final station at which completed and accepted jumpers are collected.

11. An automatic process as set forth in claim 9 including the steps of:

advancing the jumper in the transverse direction towards a ninth station;

before reaching the ninth station, marking the jumper as rejected in the event it fails to pass the tests performed at either of the seventh or eighth stations;

when the rejected jumper reaches the ninth station, ungripping it and removing it from the process for further inspection and possible repair.

12. In the automatic process as set forth in claim 5, advancing the jumper in the transverse direction towards a ninth station:

before reaching the ninth station, marking the jumper as rejected in the event it fails to pass the test performed at the fourth station;

deactivating as to a rejected jumper all stations intermediate the fourth station and the ninth station; and when the rejected jumper reaches the ninth station, ungripping it and removing it from the process for further inspection and possible repair.

13. An automatic process as set forth in claim 1 including the steps of:

entering appropriate instructions into a control unit; and performing all subsequent steps according to the instructions so entered into the unit.

14. An automatic process as set forth in claim 13 wherein the step of entering appropriate instructions into a control unit includes entering variable program requirements for job number identification and for each job so identified, length of a jumper, configuration of a jumper, and quantity of a jumper to be produced.

15. An automatic process as set forth in claim 1 including the steps of:

sensing a terminal end of the cable as it is fed from the reel;

terminating operation of the process upon sensing the terminal end of the cable; and signalling for introduction of a fresh reel of cable to replace the spent reel.

16. An automatic process as set forth in claim 15 including the steps of removing the spent reel from the process; and introducing a fresh reel of cable to replace the spent reel.

17. An automatic process as set forth in claim 1 including the steps of:

sensing external variations from a nominal diameter of the cable as it is fed from the reel; and terminating operation of the process upon sensing such external variations.

18. An automatic process as set forth in claim 1 wherein the preestablished standards include at least one of:

(a) length of the inner conductor;
(b) length of the inner insulation;
(c) length of outer conductor;
(d) length of outer insulation;
(e) continuity of the inner conductor;
(f) continuity of the outer conductor;
(g) missing or broken conductor strands;
(h) short between inner and outer conductor.

19. An automatic process as set forth in claim 1 including the step of: crimp installing coaxial contacts on each stripped end of the jumper.

20. An automatic process as set forth in claim 19 wherein the prestablished standards include at least one of:

(h) short between inner and outer conductor
(i) crimp of inner conductor too loose;
(j) crimp of inner conductor too tight;
(k) crimp of outer conductor too loose;
(l) crimp of outer conductor too tight.

* * * * *